United States Patent [19]

Kirk, Jr.

[11] B 3,985,638

[45] *Oct. 12, 1976

[54] HIGH QUALITY BLENDED JET FUEL COMPOSITION

[75] Inventor: Merritt C. Kirk, Jr., McKinney, Tex.

[73] Assignee: Sun Oil Company of Pennsylvania, Philadelphia, Pa.

[ * ] Notice: The portion of the term of this patent subsequent to Jan. 29, 1991, has been disclaimed.

[22] Filed: Jan. 30, 1974

[21] Appl. No.: 437,596

[44] Published under the second Trial Voluntary Protest Program on January 27, 1976 as document No. B 437,596.

[52] U.S. Cl. ..... 208/15; 208/57; 208/264

[51] Int. Cl.[2] ..... C10L 1/04

[58] Field of Search ..... 208/15

[56] References Cited

UNITED STATES PATENTS

| | | | |
|---|---|---|---|
| 3,146,186 | 8/1964 | Leas et al. | 208/15 |
| 3,231,489 | 1/1966 | Mahar | 208/15 |
| 3,242,066 | 3/1966 | Myers | 208/15 |
| 3,507,776 | 4/1970 | Hann | 208/15 |
| 3,594,307 | 7/1971 | Kirk | 208/15 |
| 3,788,971 | 1/1974 | Kirk | 208/15 |

*Primary Examiner*—Herbert Levine

*Attorney, Agent, or Firm*—J. Edward Hess; Donald R. Johnson; Anthony Potts, Jr.

[57] ABSTRACT

A low smoke point (e.g., 29) jet fuel can be used to produce a higher smoke point fuel (e.g., 40+) by blending with an additional more highly paraffinic fuel (e.g., high in $C_{10}$–$C_{12}$ normal paraffins) boiling mainly within the fuel oil boiling range (e.g., 10% point of at least 270°F and 90% point less than 540°F). A preferred group of paraffinic fuels comprises n-decane, n-dodecane and mixtures thereof. Hydrogenated butylene and/or propylene polymers (e.g., trimer, tetramer), preferably hydrogenated propylene "tetramer" boiling mainly above 350°F (e.g., 10% point of 360°F), can also be used as additional components. The preferred 29+ smoke point fuel for blending with n-dodecane is obtained by a two stage hydrogenation of a paraffinic straight run kerosene having an API gravity of at least 42, and containing 12 to 16 weight percent aromatics and at least 45 weight percent paraffins. The blended fuel also can have a desirably low freeze point.

9 Claims, No Drawings

HIGH QUALITY BLENDED JET FUEL COMPOSITION

CROSS REFERENCES TO RELATED APPLICATIONS

The present application is a related to my application Ser. No. 112,465, filed Feb. 3, 1971, now U.S. Pat. No. 3,788,971 issued Jan. 29, 1974, which was a continuation-in-part of Ser. No. 799,499, filed Feb. 14, 1969, now U.S. Pat. No. 3,594,307, issued July 20, 1971. Other related, commonly owned applications are as follows:

| SERIAL NO. | FILING DATE | PATENT NO. | ISSUE DATE |
|---|---|---|---|
| 781,095 | 12-4-68 | 3,481,996 | 12-2-69 |
| 636,493 | 5-5-67 | 3,681,279 | 8-1-72 |
| 532,298 | 3-7-66 | 3,424,673 | 1-28-69 |
| 515,966 | 12-23-65 | 3,309,421 | 3-14-67 |
| 225,034 | 9-20-62 | 3,256,353 | 6-14-66 |
| 197,874 | 5-28-62 | 3,155,740 | 11-3-64 |

The disclosure of all of the above patents and applications is hereby incorporated herein by reference.

SUMMARY OF THE INVENTION

Jet fuels having high smoke points (e.g., at least 35) and low freeze points (e.g., less than −20°F, typically less than −50°F) can be obtained by blending a dearomatized straight run kerosene with a paraffin component such as n-decane, n-dodecane, hydrogenated propylenen tetramer and hydrogenated butylene trimer.

A low smoke point (e.g., 29) jet fuel can be used to produce a higher smoke point fuel (e.g., 40+) by blending with an additional more highly paraffinic fuel (e.g., high in $C_{10}$–$C_{12}$ normal paraffins) boiling mainly within the fuel oil boiling range (e.g., 10% point of at least 270°F and 90% point less than 540°F). A preferred group of paraffinic fuels comprises n-decane, n-dodecane and mixtures thereof. Hydrogenated butylene and/or propylene polymers (e.g., trimer, tetramer), preferably hydrogenated propylene "tetramer" boiling mainly above 350°F (e.g., 10% point of 360°F), can also be used as additional components. The preferred 29+ smoke point fuel for blending with n-dodecane is obtained by a two stage hydrogenation of a paraffinic straight run kerosene having an API gravity of at least 42, and containing 12 to 16 weight percent aromatics and at least 45 weight percent paraffins. Aromatics can also be removed from kerosene or hydrogenated kerosene by solvent extraction (as with $H_2SO_4$ or furfural) or by contact with an adsorbent (e.g., silica gel or zeolites). The blended fuel also can have a desirably low freeze point.

FURTHER DESCRIPTION OF THE INVENTION

This invention relates to the production of jet fuel (such as "MACH 2 JP-5" or "JP-5A") and special fuels requiring a luminometer number above 75 (e.g., 75 to 100) by hydrogenation of petroleum charges having a sufficient content of aromatic or olefinic hydrocarbons to cause them to have an ASTM smoke point below 28 (typically below 25). Preferably, the olefinic or aromatic hydrocarbons in such charges must be such that they can be converted by deep hydrogenation to materials boiling mainly within the boiling range specified for the desired jet fuel, or that the product stream containing the hydrogenation product of these aromatic hydrocarbons boils mainly within the range specified for the desired jet fuel. Also, the aromatic and/or olefin-containing stream, or the aromatics and/or olefins which are hydrogenated, should be capable of being convertedupon deep hydrogenation, to a product having a smoke point of at least 29 (more preferably, at least 35).

Among the streams which are suitable feed stocks (or charges) for conversion to jet fuel by such a deep hydrogenation process are the heavy recycle from reforming of naphtha, straight-run kerosene, catalytic gas oil, straight chain $C_{10}$–$C_{18}$ olefins (e.g., propylene tetramer and/or pentamer, etc.), distillate from thermally cracked tar sands bitumen, distillate fractions of such feed stocks and blends of two or more such feed stocks and blends of two or more such feed stocks (including blends of distillate fractions of such feed stocks). One preferred charge stock is a straight-run kerosene containing at least 9 weight percent of aromatics (e.g., 9 to 16%) and which boils mainly in the range of 400 to 500°F. Another suitable charge stock is the 400° to 500°F fraction from the catalytic cracking of gas oils (including hydrocracking).

Also suitable is a charge comprising jet fuel range distillate (e.g., boiling mainly in the range of 350° to 550°F) from "coked" bitumen separated from tar sands (as by the hot water process). Typical of the prior art on such separations of bitumen from tar sands and further treatment to yield such distillates are U.S. Pat. No. 3,401,110 to Floyd et al. and "Plant Starts, Athabasca Now Yielding Its Hydrocarbons" in OIL AND GAS JOURNAL, Oct. 23, 1967 by Bachman, W. and Stormont, D. For the first hydrogenation stage of the present invention, such distillate from thermally cracked bitumen is preferably reduced to less than 35 weight percent olefins and aromatics by contact with a catalyst comprising cobalt and/or nickel and molybdenum (most preferably in sulfide form) and with 75 to 95% pure hydrogen at 800 psi to 3000 psi (preferably 1000 to 2000 psig), at 650° to 750°F, at a liquid hourly space velocity in the range of 0.25 to 2.5 (typically 0.75 to 1.25) at a gas recycle of at least 3000 scf per barrel (typically 4000 to 8000). Such distillate can also be advantageously blended with at least one other of the previously referred to charge stocks to produce a suitable charge for the two stage hydrogenation process of the present invention.

For all such charges, the desired deep hydrogenation can be effected by a two-stage catalytic hydrogenation process.

In the first stage, the petroleum charge stock is contacted with hydrogen (preferably 50 to 100% pure $H_2$, typically 80 to 90%) and a catalyst, primarily in order to remove sulfur and nitrogen compounds (however, some saturation can also be effected in this stage). The preferred catalyst will contain at least one member selected from the group consisting of nickel, cobalt, iron, molybdenum and tungsten and oxides and sulfides thereof, preferably on an inert porous carrier. Conditions include a temperature in the range of 500° to 785°F (for example, 650° to 750°F) at a pressure of 350 to 3000 psig (for example, 500 to 1500 psig) with a liquid hourly space velocity of 0.5 to 10.0 (for example, 1.0 to 6.0) and a hydrogen circulation rate of 0 to 20,000 standard cubic feet per barrel of charge stock (for example, 1,500 to 10,000 scf per barrel).

The product of this first "hydrodesulfurization" or "hydrorefining" step is then contacted in a second hydrogenation stage (preferably with 65 to 100% pure hydrogen) at a temperature from 450° to 775°F (for example, 450° to 700°F) at a pressure of 500 to 3000 psig (for example, 500 to 1500 psig), a liquid hourly space velocity of about 0.25 to 10.0 (e.g., 1 to 10.0) and a hydrogen circulation rate of 0 to 20,000 (e.g., 2,000 to 10,000) scf per barrel of the product of the first stage.

The combination of the conditions in each of the two hydrogenation stages is selected to produce a superior jet fuel having a luminometer number of at least 75. Such a luminometer number is obtained with the ASTM smoke point is at least 29 (and, with our preferred charge stocks, when the ASTM smoke point is at least 33, more preferably, at least 35). The art is familiar with a correlation developed by the California Research Corporation, whereby the luminocity number can be determined from the ASTM smoke point, or vice versa. By this correlation, it has been established that, for example, the maximum luminocity number which can be obtained from petroleum based fuel having a smoke point of 25 is about 65 (and the minimum about 50). Similarly, the correlation shows that to obtain a luminocity number of 75 from a petroleum fuel, the ASTM smoke point must be at least 29 and may have to be as high as 35 (i.e., $32 \pm 3$).

Conversely, for fuels having smoke points of 29, the luminocity can vary from about 62 to 75.

Preferred catalysts in the second hydrogenation stage are those which comprise a metal selected from the group consisting of nickel, cobalt, tungsten, molybdenum, ruthenium, rhodium, osmium, iridium and the noble metal hydrogenation catalysts (e.g., platinum, and palladium). Preferably, said catalyst is supported on a porous refractory support which does not have appreciable cracking activity at the contact conditions (for example, alumina, kieselguhr, carbon, etc.). The second stage catalyst can also comprise sulfides (or sulfided oxides) of such metals when at least a trace (5 to 50 ppm) of sulfur (preferably as $H_2S$ or organic sulfides) is maintained in the charge to the second stage.

Generally, when the charge stock comprises acyclic $C_9$–$C_{18}$ olefins, a straight-run kerosene, or a fraction derived from hydrocracking a gas oil (or from hydrocracking a heavy distillate from crude oil), or comprises blends or at least two such charges, the resulting product from the second hydrogenation stage will have a luminometer number of at least 75 when the product of the second hydrogenation stage contains less than 8 weight percent of aromatics and olefins. More preferably, the second stage product contains less than 4 percent (typically 0 to 2%) of aromatics and less than 10% of olefins.

However, for any given charge stock, it is within the skill of the art to determine, by a series of experiments, the degree of hydrogenation which is necessary to produce a second stage product having the required luminometer number.

When the feed stock is highly aromatic, such as a nonhydrocracked catalytic gas oil, coked distillate from tar sands bitumen, or the recycle fraction from the reforming of naphtha, non-destructive hydrogenation alone (even in two stages) may not be sufficient processing to produce a jet fuel having a luminometer number of at least 75. With such highly aromatic feed stocks (which upon deep hydrogenation convert to products having a high content of naphthene hydrocarbons) it is frequently desirable to reduce the proportion of naphthenic carbon atoms to paraffinic carbon atoms in the final fuel. This can be effected by the means taught in the above-referred to U.S. Pat. Nos. 3,481,996 and 3,424,673.

For example, a fraction which contains dimethylnaphthalenes and boils mainly in the range of 480 to 540°F can be alkylated with a $C_2$–$C_9$ hydrocarbon. The alkylated fraction can then be distilled to recover a fraction boiling substantially within the range of 480° to 540°F (and containing a lower proportion of aromatic hydrocarbons then were present in the charge to the alkylation reactor) and a higher boiling fraction which is useful as a plasticizer. The resulting 480° to 540°F distillate fraction of the alkylate can then be catalytically hydrogenated in a second step to produce a second stage hydrogenation product having a luminometer number of at least 75. If, with a particular charge stock and particular alkylation and distillation processes, the second stage hydrogenation product has a luminometer number less than 75, the luminometer number can be increased to at least 75 by utilizing the additional process step taught, for example, in the previously referred to application U.S. Pat. No. 3,481,996 wherein the product of the second hydrogenation stage is distilled to recover a fraction containing at least 90% dimethyldecalins and boiling in the range of 400 to 450°F. The remaining fractions of this distillation can be especially useful as a jet fuel or as components of a jet fuel having a luminometer number of at least 75.

As an alternative, the aromatic content of a catalytic gas oil (or other highly aromatic charge) can be reduced by extraction with an acid (e.g., $H_2SO_4$) or with an aromatic selective solvent such as phenol or furfural, and the resultant aromatic-depleted product can be utilized as the feed to either the first stage or to the second stage of the above-referred to two stage hydrogenation process.

Another alternative open to the refiner is to produce a second stage hydrogenation product which has a luminometer value less than 75, and to then feed this product to a hydrocracking zone under conditions such that the hydrocracked product can be distilled to produce a jet fuel having the desired luminometer value.

Another alternative with highly aromatic feeds, such as catalytic gas oil, is to conduct the hydrogenation in at least one stage under conditions such that some hydrocracking occurs (e.g., 10 to 30 volume percent conversion to lower boiling products). In such hydrotreating combined with hydrocracking, it is preferred that the carrier for the hydrogenation catalyst have some cracking activity (or acidity), such as can be obtained with an acidic alumino-silicate zeolite which is substantially free from alkali metals (for example, 10%) of HY zeolite in a silica alumina matrix). Another catalyst which is useful for both hydrogenating and also for partially hydrocracking (especially in the second hydrogenation stage) comprises nickel and tungsten on an alumino-silicate carrier (such as the commercially available catalyst sold by Harshaw Chemical under the trade name Ni-4401).

Where hydrocracking activity is not desired (or is to be minimized), a suitable catalyst for deep hydrogenation is nickel-tungsten on $Al_2O_3$ (such as the commercially available catalyst from Harshaw Chemical having the trade designation Ni-4403). For example, one such type of commercial catalyst contains 7.6 wieght percent NiO, 23.9 weight percent $WO_3$ and the remainder is either $Al_2O_3$ or an alumino-silicate containing 43% $Al_2O_3$. Another suitable catalyst for the second stage is sold under the trade designation Filtrol 500-8 and is nickel-cobalt-molybdenum on $Al_2O_3$. In the first stage, the preferred catalysts comprise cobalt and molybdenum oxides on a carrier (such as bauxite or alpha-alumina) or nickel-molybdenum oxides on a carrier. Preferably, these catalysts are presulfided.

When the charge stock which is to be converted into a jet fuel having a luminometer number of at least 75 has a high content of aromatic hydrocarbons, such as a 400° to 550°F gas oil (or coker distillate from tar sands bitumen), a preferred process is that shown in parent application U.S. Pat. No. 3,424,673) wherein the 400° to 550°F charge stock (which can be a catalytic gas oil) is hydrodesulfurized (as in the first stage of the present process) and the hydrodesulfurized product is separated, by distillation, into a fraction boiling below 480°F, a fraction boiling above 540°F, and a fraction containing dimethylnaphthalene and boiling mainly in the range of 480° to 540°F. The 480° to 540°F feed fraction is then catalytically hydrogenated to an aromatics content less than 8% under hydrogenation conditions comprising a temperature in the range of 400° to 1000°F, a pressure in the range of 500 to 4000 psig, a liquid hourly space velocity in the range of 0.1 to 10.0 and in the presence of 500 to 15,000 scf of hydrogen per barrel of hydrocarbon feed. The hydrogenated product is distilled to separate a fraction containing at least 90% dimethyldecalin and boiling in the range of 400° to 450°F. Most preferably, the first hydrogenation stage is conducted under conditions such that the first stage hydrodesulfurized product contains less than 300 ppm (preferably under 50 ppm) of sulfur. All of the material in the 400° to 550°F fraction which is the feed to the first stage and which is not recovered as dimethyldecalins, can be combined with the desulfurized fraction boiling below 480°F to produce a jet fuel having a luminometer value of at least 75.

ILLUSTRATIVE EXAMPLES

A straight-run kerosene meeting the specifications for JP-5 and having the properties listed in Table I under the heading "charge", and containing 12.4% aromatics, was hydrodesulfurized in the presence of a sulfided catalyst comprising cobalt and molybdenum oxides on alumina (which catalyst was commercially available under the trade name Acro HDS-2). The hydrodesulfurization was conducted at 750 psig and 600°F at a liquid hourly space velocity of 2 and with a hydrogen recycle of 5,000 scf per barrel of charge. The hydrodesulfurized product was then charged to a second hydrogenation stage wherein the catalyst was nickel on kieselguhr. The second stage hydrogenation was conducted at 500°F and at 500 psig, at a liquid hourly space velocity of 0.75 with a hydrogen recycle of 10,000 scf per barrel of feed. The product of the second hydrogenation stage contained only 0.05% by weight of aromatic hydrocarbons and had a smoke number of 35. Other properties of this two stage product, are listed in the t table under the heading JP-5A. From the California Research correlation, a smoke number of 35, for the second stage product, corresponds to a luminometer number of 82.

Table I also lists, for purposes of comparison, runs made on the same straight-run kerosene wherein only a single hydrogenation (or hydrodesulfurization) stage was used. Also shown, for comparison purposes, are similar runs made on propylene tetramer (which is a product obtained by the catalytic polymerization of propylene in the presence of a phosphoric acid on kieselguhr catalyst). The hydrogenated propylene tetramer makes an excellent blending stock for incorporating with our two stage hydrogenation products (or other dearomatized kerosenes) in order to make products having luminometer values above 85 (surprisingly, such hydrogenated acyclic olefins can be produced which have luminometer values of 100).

For example, 25 to 35 volume percent hydrogenated propylene tetramer having a 40 smoke point can be blended with from 75 to 65 volume percent of the above-described 35 smoke point product from the two stage hydrogenation, to produce a fuel having a high smoke point and low freeze point. Such a high smoke point, low freeze point blended fuel can also be obtained when from 25 to 35 volume percent of the hydrogenated tetramer or of n-decane is blended with dearomatized straight-run paraffinic kerosene. Such a dearomatized straight-run paraffinic kerosene can be obtained by 90 to 100% removal of aromatics from a straight-run kerosene which meets JP-5 specifications. The aromatics can be removed by contacting the kerosene with a strong acid (e.g., $H_2SO_4$), an aromatic selective solvent (e.g., phenol) or an adsorbent (e.g., silica gel, type Y or type X faujacite).

A fuel having a freeze point of −69°F and a smoke point of greater than 45 was obtained by blending a completely dearomatized straight-run paraffinic kerosene (similar to the charge in Table I) with 23.5 volume percent of n-decane. A similar blend but with 28.4% dodecane instead of the n-decane, produced a blended jet fuel having a 38 smoke point and a −22°F freeze point. Another highly paraffinic fuel which can be useful per se or as a blending component is obtained by hydrotreating a straight-run kerosene (as in the first stage of the two stage process described herein) and then conducting the second stage under reforming conditions (platinum or platinum-rhenium catalyst, 775° to 950°F, 200 to 600 psig, 65 to 95 mole percent hydrogen in recycle, 4:1 to 10:1 hydrogen to hydrocarbon ratio) and then to dearomatize this second stage product by removal of the aromatics (as with silica gel). This dearomatized reformate can have a smoke point greater than 45. Hydrotreated, reformed, dearomatized fuels are shown in British Patent No. 870,474 published June 14, 1971.

Table II herein describes typical properties of blends of n-decane and a dearomatized kerosene ("JP-5") and show synergistic blending with respect to smoke point. While n-decane is too light for some special jet fuels, a higher molecular weight n-paraffin might be acceptable. Blends were also made of normal dodecane or n-cetane in dearomatized JP-5. These blends were designed to give 100 luminometer number (42 ± 2 smoke point). The blends were synergistic with the possible exception of n-dodecane-dearomatized JP-5. The results are shown in Table III. These data indicate that a $C_{11}$–$C_{12}$ cut from Wilshire crude mixed with JP-5 and acid treated (to remove aromatics) would also make a good jet fuel.

One interesting point in the n-decane-dearomatized JP-5 blends is the lowering of freeze point below that of the dearomatized JP-5 with high concentration of n-decane. This could be caused by a eutectic in this system.

Table IV shows properties of certain dearomatized kerosenes which are useful in blends containing n-decane and/or n-dodecane.

The dearomatized kerosenes described herein and blends thereof with $C_{10}$–$C_{16}$ paraffins are also useful as solvents where no or low aromatic content is desired (such as with Ziegler-type catalysts) and as carriers (as for a herbicide, insecticide, etc.).

TABLE II-continued n-DECANE ENRICHMENT OF DEAROMATIZED JP-5

| COMPOSITION OF BLEND, VOLUME PERCENT | | | | | |
|---|---|---|---|---|---|
| Freeze Point, °F | −50 | −50 | −51 | −50 | −30 max |

TABLE III

HIGH PERFORMANCE JET FUEL BLENDS

| Description | Volume Percent | Smoke Point, mm | Freeze Point, °F |
|---|---|---|---|
| n-decane | 23.5 | 45 | −64 |
| Dearom JP-5 | 76.5 | | |
| n-decane | 30.6 | 45 | −64 |
| Dearom JP-5 | 69.4 | | |
| n-dodecanes | 28.4 | 38 | −23 |
| Dearom JP-5 | 71.6 | | |
| n-octane | 39.7 | 45 | +44 |
| Dearom JP-5 | 60.3 | | |
| n-decane | 100 | 45 | −22* |
| n-dodecane | 100 | 45 | +22+ |
| n-octane | 100 | 41 | +70++ |
| Dearom 300+ Ref'md JP-5 | 100 | 45 | — |
| Dearom 300+ Reformed Naph Plant Raff. | 100 | 45 | — |
| Dearom 300+ Ref. Plt. 8-C Naphtha | 100 | 45 | — |
| Dearom $H_2$ JP-5 | 100 | 39 | −54 |
| Dearom JP-5 | 100 | 45 | −52 |

*This checks the literature value of −22°F
+The literature value is +15°F
++The literature value is +65°F

TABLE I

PREPARATION OF JET FUELS

| Charge Stock | JP-5 | | | | | Propylene Tetramer | | |
|---|---|---|---|---|---|---|---|---|
| Operation | Deep Hydrogenation of Aromatics | | | Moderate Hydrogenation of Aromatics | | Saturation of Olefins | | |
| Catalyst Type | (1) Two Stages (2) | CoMo Ni | Ni-W | Ni-W | CoMo | | CoMo | |
| Reactor Conditions | (1) | (2) | | | | | | |
| Operating Pressure, psig | 750 | 500 | 1800 | 750 | 750 | | 750 | 500 |
| One Recycle Rate, scf/bbl | 5000 | 10000 | 5000 | 0 | 0 | | 0 | 3000 |
| Temperature (°F) | 725 | 500 | 575 | 600 | 600 | | 600 | 600 |
| Liquid Hourly Space Velocity | 2 | 0.75 | 1 | 1.5 | 1 | | 2 | 2 |
| | Charge | | | | | Charge | | |
| Inspection Data | | | | | | | | |
| Gravity, °API | 43.9 | 45.3 | 44.8 | 44.4 | 44.1 | 52.1 | 54.2 | 54.1 |
| Distillation (Engler) (°F) | | | | | | | | |
| 10% | 393 | 392 | 393 | 388 | 396 | 358 | 360 | 363 |
| 50% | 419 | 418 | 418 | 419 | 418 | 365 | 370 | 371 |
| 90% | 465 | 452 | 444 | 449 | 448 | 380 | 383 | 384 |
| Aromatics, Wt.% | 12.4 | 0.05 | 4.0 | — | 9.8 | — | — | — |
| Olefins, Wt.% | — | — | — | — | — | 92.4 | 6.4 | 3.8 |
| Freezing Point, °F | — | −54 | −51 | −58 | −58 | — | −76 | −76 |
| Flash Point (cc), °F | 154 | 148 | — | — | 146 | 136 | 136 | 138 |
| *Luminometer No. (Est.) | — | 82 | — | — | 146 | 136 | 136 | 138 |
| Smoke Point | 24 | 35 | — | 30 | 27 | — | 40 | 39 |
| Aniline Point, °F | 149.5 | 164.6 | — | — | — | — | 175.0 | 176.4 |

(1) Desulfurization Step
(2) Deep Hydrogenation Step
*Luminometer number estimated from smoke point.

TABLE II n-DECANE ENRICHMENT OF DEAROMATIZED JP-5

| COMPOSITION OF BLEND, VOLUME PERCENT | | | | | |
|---|---|---|---|---|---|
| n-Decane | 0 | 5 | 10 | 15 | Typical Ranges |
| Dearomatized JP-5 | 100 | 95 | 90 | 85 | Spec. |
| Gravity, °API | 46.7 | 47.2 | 47.8 | 48.6 | 47–53 |
| ASTM Dist., °F | | | | | |
| IBP | 364 | 360 | 354 | 350 | 375 min |
| 5 | 384 | 380 | 374 | 370 | |
| 10 | 393 | 387 | 382 | 377 | 400 min |
| 20 | 402 | 395 | 390 | 382 | |
| 30 | 408 | 401 | 398 | 390 | |
| 40 | 412 | 406 | 403 | 397 | |
| 50 | 417 | 412 | 410 | 404 | 420 min |
| 60 | 422 | 418 | 416 | 412 | |
| 70 | 427 | 425 | 422 | 420 | |
| 80 | 435 | 432 | 430 | 429 | |
| 90 | 446 | 444 | 444 | 442 | 500 max |
| 95 | 460 | 457 | 456 | 454 | |
| EP | 472 | 476 | 474 | 474 | 550 max |
| Recovered, % | 98 | 98 | 98 | 98 | 98 min |
| Smoke Point, mm | 33 | 36 | 39 | 41 | 42±2 min |

TABLE IV

EXPERIMENTAL JET FUEL BLENDS

| Blend Number Composition, Volume Percent | No. 1 | No. 2 | No. 3 | No. 4 | No. 5 |
|---|---|---|---|---|---|
| 375–400°F Wilshire, Dearomatized | 17 | 31 | — | 56 | 16 |
| 400–425°F Wilshire, Dearomatized | 13 | 24 | — | 44 | 12 |

TABLE IV-continued

EXPERIMENTAL JET FUEL BLENDS

| Blend Number<br>Composition, Volume Percent | | No. 1 | No. 2 | No. 3 | No. 4 | No. 5 |
|---|---|---|---|---|---|---|
| 425—450°F Wilshire, Dearomatized | | — | 16 | — | — | 8 |
| 450–475°F Wilshire, Dearomatized | | — | 29 | — | — | 14 |
| Dearomatized JP-5 | | 70 | — | 100 | — | 50 |
| | Typical Range | | | | | |
| Gravity, °API | 47.0–53 | 47.0 | 50.1 | 45.3 | 51.4 | 47.9 |
| IBP | 375 min | 374 | 392 | 372 | 378 | 380 |
| 5 | — | 388 | 400 | 390 | 384 | 394 |
| 10 | 400 min | 392 | 402 | 396 | 386 | 400 |
| 20 | — | 398 | 404 | 404 | 388 | 404 |
| 30 | — | 400 | 408 | 408 | 488 | 408 |
| 40 | — | 404 | 410 | 414 | 390 | 412 |
| 50 | 420 min | 408 | 412 | 418 | 390 | 416 |
| 60 | — | 412 | 414 | 422 | 392 | 418 |
| 70 | — | 416 | 418 | 428 | 392 | 424 |
| 80 | — | 424 | 426 | 434 | 394 | 430 |
| 90 | 500 max | 426 | 436 | 446 | 400 | 440 |
| 95 | — | 438 | 440 | 460 | 404 | 456 |
| EP/Rec. | 550 max | 472/98 | 460/98 | 480/98 | 424/98 | 470/98 |
| Freeze Point, °F | −30 max | −50 | −28 | −53 | −39 | −38 |
| Luminometer Number | 100 min | 76.8 | 103.5 | 74.6 | 100.0 | 79.6 |

The invention claimed is:

1. A composition having a freezing point lower than −40°F, comprising a blend of (A) a straight-run paraffinic kerosene in which the aromatic hydrocarbons have been reduced to provide a smoke point greater than 28 and (B) in the range of 23.5 to 40 volume percent of n-decane.

2. A composition according to claim 1 wherein said kerosene having a smoke point greater than 29 is produced by hydrogenation of a straight-run kerosene having an API gravity of at least 42.

3. The composition of claim 2 and which is useful as a jet fuel.

4. Composition according to claim 1 wherein said blend consists essentially of n-decane and said kerosene.

5. Composition according to claim 1 wherein said paraffin consists essentially of n-decane and n-dodecane.

6. The composition of claim 1 and having a smoke point of at least 35.

7. The composition of claim 1 wherein said paraffinic kerosene had a smoke point below 28 prior to reducing its aromatic content.

8. A composition according to claim 1 wherein said dearomatized kerosene is produced by contacting a straight-run kerosene having an API gravity of at least 42 with silica gel.

9. A composition according to claim 1 and having an ASTM smoke point of at least 35 mm wherein said kerosene component of said blend is obtained by contacting a straight-run paraffinic kerosene having a smoke point below 28 and an API gravity of at least 42 with hydrogen in the presence of a hydrogenation catalyst formed from at least one member selected from the group consisting of nickel, cobalt, molybdenum and tungsten and oxides and sulfides thereof, on an inert porous carrier, at a temperature of 500°F to below 650°F, at a pressure of 500 to 1500 psig with a liquid hourly space velocity of 1.0 to 6.0 and a hydrogen circulation rate of 1,500 to 10,000 standard cubic feet per barrel of kerosene, contacting the resultant product with hydrogen in the presence of a catalyst which comprises a metal selected from the group consisting of nickel, cobalt, tungsten, molybdenum and the noble metals, said catalyst being supported on a porous refractory support selected from the group consisting of alumina and kieselguhr, at a temperature of 450° to 700°F at a pressure of 500 to 1500 psig, a liquid hourly space velocity of 0.5 to 10.0 and a hydrogen circulation rate of 0 to 20,000 standard cubic feet per barrel of said product of the first stage, the combination of conditions being selected to produce a dearomatized kerosene, which is useful as a jet fuel and has a luminometer number of at least 75 and an ASTM smoke point of at least 29 mm.

* * * * *